US010336580B2

(12) United States Patent
Cereghetti et al.

(10) Patent No.: US 10,336,580 B2
(45) Date of Patent: Jul. 2, 2019

(54) METHOD AND DEVICE FOR CHECKING THE INTEGRITY OF LOAD BEARING MEMBERS OF AN ELEVATOR SYSTEM

(71) Applicants: Igino Cereghetti, Sion (CH); Simone Pellascio, Losone (CH)

(72) Inventors: Igino Cereghetti, Sion (CH); Simone Pellascio, Losone (CH)

(73) Assignee: Kone Corporation, Helsinki (FI)

( * ) Notice: Subject to any disclaimer, the term of this patent is extended or adjusted under 35 U.S.C. 154(b) by 534 days.

(21) Appl. No.: 15/099,997

(22) Filed: Apr. 15, 2016

(65) Prior Publication Data

US 2016/0229667 A1 Aug. 11, 2016

Related U.S. Application Data

(63) Continuation of application No. PCT/EP2013/072078, filed on Oct. 22, 2013.

(51) Int. Cl.
*B66B 1/34* (2006.01)
*B66B 7/12* (2006.01)

(52) U.S. Cl.
CPC ..... *B66B 7/1223* (2013.01)

(58) Field of Classification Search
CPC ..... B66B 7/1223
USPC ..... 187/247, 391, 393; 324/71.1, 539, 691, 324/693, 695, 700, 705, 706, 718, 725; 73/862.391, 810
See application file for complete search history.

(56) References Cited

U.S. PATENT DOCUMENTS 3,958,455 A * 5/1976 Russell ..... G01L 1/22 73/862.68
5,731,528 A * 3/1998 Yamazaki ..... G01L 5/042 73/828
6,633,159 B1 10/2003 Robar et al.
6,923,065 B2 * 8/2005 Smith ..... B66B 7/1215 324/535
7,409,870 B2 * 8/2008 Stucky ..... B66B 7/062 73/810
8,011,479 B2 * 9/2011 Stucky ..... B66B 7/1223 187/391
8,813,918 B2 * 8/2014 Kocher ..... B66B 7/1223 187/391
9,327,941 B2 * 5/2016 Dold ..... B66B 7/1223
(Continued)

FOREIGN PATENT DOCUMENTS

CN 1613740 A 5/2005
CN 1227526 C 11/2005
(Continued)

OTHER PUBLICATIONS

International Search Report PCT/ISA/210 for International Application No. PCT/EP2013/072078 dated Jun. 13, 2014.
(Continued)

*Primary Examiner* — Anthony J Salata
(74) *Attorney, Agent, or Firm* — Harness, Dickey & Pierce, P.L.C.

(57) ABSTRACT

A method for checking the integrity of a load bearing member of an elevator including tensile elements encapsulated in a case includes the steps of launching a source pulse through tensile elements of said load bearing member and comparing the feedback of said tensile elements with a comparator; tensile elements can be bridged to avoid a blind zone.

19 Claims, 2 Drawing Sheets

(56) References Cited

U.S. PATENT DOCUMENTS

| | | | | |
|---|---|---|---|---|
| 9,599,582 | B2 * | 3/2017 | Fargo | G01N 27/20 |
| 9,862,571 | B2 * | 1/2018 | Sun | B66B 7/1223 |
| 9,932,203 | B2 * | 4/2018 | Robibero | B66B 7/1215 |
| 9,975,734 | B2 * | 5/2018 | Dold | B66B 7/1223 |
| 2002/0194935 | A1 * | 12/2002 | Clarke | B66B 7/1223 73/862.391 |
| 2003/0121729 | A1 * | 7/2003 | Heinz | B66B 7/062 187/254 |
| 2004/0046540 | A1 | 3/2004 | Robar et al. | |
| 2007/0180925 | A1 | 8/2007 | Stucky et al. | |
| 2018/0134520 | A1 * | 5/2018 | Mikkonen | B66B 7/08 |

FOREIGN PATENT DOCUMENTS

| | | | |
|---|---|---|---|
| CN | 1926043 | A | 3/2007 |
| CN | 101263073 | A | 9/2008 |
| GB | 1362514 | A | 8/1974 |
| JP | 2013-147315 | A | 8/2013 |
| WO | WO-00/58706 | A2 | 10/2000 |
| WO | WO-2005095252 | A1 | 10/2005 |
| WO | WO-2009090299 | A1 | 7/2009 |
| WO | WO-2013135285 | A1 | 9/2013 |
| WO | WO-2013140038 | A1 | 9/2013 |

OTHER PUBLICATIONS

Written Written Opinion of the International Searching Authority PCT/ISA/237 for International Application No. PCT/EP2013/072078 dated Jun. 13, 2014.

* cited by examiner

METHOD AND DEVICE FOR CHECKING THE INTEGRITY OF LOAD BEARING MEMBERS OF AN ELEVATOR SYSTEM

This application is a continuation of PCT International Application No. PCT/EP2013/072078 which has an International filing date of Oct. 22, 2013, the entire contents of which are incorporated herein by reference.

DESCRIPTION

Field of the Invention

The invention relates to a non-visual method for determining the condition of a load bearing member of an elevator. The invention relates in particular to the checking of elevator load bearing members comprising tensile elements encapsulated in a case.

Prior Art

A known type of load bearing members for elevators comprises tensile elements encapsulated in a case. Internally reinforced belts are an example of such load bearing members, which provide several advantages over the conventional steel ropes. A traction member for elevators having a number of steel cords encapsulated in a plastic medium is disclosed for example in GB-A-1362514.

The visual inspection of the internal tensile elements is generally not possible and hence the need arises for non-visual inspection. A known method for checking the condition of the tensile elements is the resistance-based inspection, which is based on a measure of the electrical resistance of the tensile elements. A change in the electrical resistance or a deviation from an expected value are interpreted as a damage of the tensile elements.

It has been found, however, that non negligible damages may nevertheless result in small variations of the electrical resistance of common tensile elements such as steel cords. Consequently, the sensitivity of the resistance-based inspection is not satisfactory.

Another drawback is that the absolute measure of the electric resistance of a tensile element is affected by several boundary conditions. Factors that may influence the measure include the temperature, the load and related stress, and also the winding of the load-bearing member around a pulley, which may generate an inductance. A certain deviation from the expected value may arise from said boundary conditions and lead to a false alarm. Taking account of said factors may further reduce the sensitivity of the test.

The purpose of the invention is to eliminate the above drawbacks. In particular, the invention aims to a method for testing electrically conductive tensile elements of a load-bearing member of an elevator, which is safer and more reliable than conventional resistance-based systems.

SUMMARY OF THE INVENTION

The idea of the invention it to determine the condition of a tensile element by sending a pulse through the tensile element and analysing the feedback pulse which is received from the tensile element. The analysis can be performed with TDR (time domain reflectometer) technique. The feedback of at least two tensile elements is compared according to the method. Since it is assumed that the tensile elements should have the same behaviour, the same feedback is expected; a different feedback from a tensile element can reveal a possible damage.

An aspect of the invention is a method for checking at least one load bearing member of an elevator system. Said load bearing member comprises tensile elements of electrically conductive material encapsulated in a case and the method comprises the steps of:

a) launching a first source pulse through a first tensile element of said load bearing member,
b) launching a second source pulse through a second tensile element of said load bearing member or of another load bearing member of said elevator system,
c) making a comparison between a feedback received from said first tensile element and a feedback received from said second tensile element, and
d) determining a condition of said tensile elements based on said comparison.

The feedback of the tensile elements shall be understood as the detection of a feedback pulse with certain features, or detection of no feedback pulse. In some embodiments (e.g. grounded tensile elements), it is expected that undamaged and uniform tensile elements provide no feedback, and hence a feedback pulse may reveal a damage, for example a non-uniformity of the internal structure which generates a reflection of the source pulse. In some other embodiments (non-grounded), the undamaged and uniform tensile elements are expected to provide a feedback pulse with certain features.

In all the above cases, a deviation between the feedback of two tensile elements can be interpreted as a damage. It is believed that, in most cases, it will be unlikely that two tensile elements are damaged in the same way and at the same time. Factors like aging, stress, temperature, etc. are believed to affect all the tensile elements substantially in the same manner. Hence, when the feedback of a tensile element deviates from the feedback of another element, it is likely that at least one of the two tensile elements is damaged.

Another possibility to inspect the load-bearing member, in accordance with the invention, is to select the tensile elements which are compared each other according to a predetermined pattern. A random pattern can also be used.

It should be noted that this method, due to its comparative nature, is not affected by factors like the winding of the load-bearing member on a pulley, the load distribution, and others. Accordingly, the risk of false alarms is reduced and the method is more reliable.

Preferably, a damage condition of one of said first tensile element and second tensile element is determined when a detected difference of the feedback is greater than a predetermined threshold.

The term of elevator system used in this description and in the claims shall be understood as a system including a single load-bearing member or a plurality of load bearing members. A car is usually suspended to at least two load-bearing members, to comply with the applicable norms, and a plurality of redundant load-bearing members can be used to increase safety. Said elevator system may comprise also comprise more than one elevator and related load-bearing members. According to various embodiments of the invention, a tensile element of a load-bearing member can be checked by making a comparison with one or more tensile elements of the same load-bearing member, or with one or more tensile elements of one or more other load-bearing member(s) of the elevator system. Preferably, the tensile elements of a load-bearing member are compared with the tensile elements of one or more near load-bearing member(s) since it is expected that near load-bearing members are subject to similar working conditions and load and hence they provide a reliable reference.

In some embodiments, the method includes the performing of a cross-check when a possible damage condition is detected. For example, when a difference of feedback between two tensile elements is detected, at least one of said first tensile element and second tensile element can be compared to at least a third tensile element of the load-bearing member. The performing of a cross-check helps to further reduce the risk of a false alarm and may detect which one of the tensile elements is damaged.

More generally, certain preferred embodiments may provide that the tensile elements of a load-bearing member are checked by testing pairs of tensile elements according to steps a) to d) as defined above, and the pairs are selected in such a way that feedback of each tensile element is compared to the feedback of a plurality of other tensile elements of the same or other load-bearing member(s). The pairs of tensile elements which are compared to each other may be selected randomly or in accordance with a predetermined pattern. In one of the various embodiments, the tensile elements are scanned by comparing the feedback of each tensile element to the feedback of each one of the other tensile elements of a load-bearing member. For example if tensile elements are numbered 1, 2, 3, . . . n, the invention provides the comparison 1 vs. 2, 1 vs. 3, . . . 1, vs. n; then 2 vs. 3, 2 vs. 4, . . . and so on.

The comparison of the feedback may include any of: a measure of the time elapsed between the launch of the source pulse and the receipt of a feedback pulse, if any; determination of amplitude of a feedback pulse, determination of the duration of a feedback pulse; analysis of the waveform of a feedback pulse, or a combination thereof.

The elapsed time can be measured very precisely. As mentioned above, a damage will typically originate a reflection of the source pulse and then a feedback pulse. The elapsed time can be used to calculate the location of the damage as a function of the known speed of the pulse in the tensile element. Other features such as the waveform of said feedback pulse may help understanding the nature of the damage, e.g. a short circuit or interruption.

Accordingly, the method is more sensitive and provides more information than resistance-based methods of the prior art, which require determination of an electrical resistance.

Preferably, the first source pulse and the second source pulse are identical and more preferably they are launched simultaneously.

The above method will typically have a so-called blind region, namely a region which is too close to the point of injection of the source pulse for a damage to be detected. Said blind area can be eliminated with the bridged embodiments of the invention.

The bridged embodiments involve that two tensile elements are bridged in pairs, and are tested by alternately launching the source pulse into, and detecting the feedback pulse from, the two tensile elements forming a pair according to the attached claim 6. Hence, a damage near the point of the injection of the first launch and in the blind area will be detected with the second launch.

Another way to eliminate the blind area is to provide a certain dead length of the load-bearing member, which is not stressed during the use, for example being after a fixed point. The length of said dead portion is at least equal to the length of the blind region, in such a way that the useful portion of the load-bearing member is outside the blind region and any damage located therein is detectable.

The following preferred features may apply to the various embodiments of the invention.

A deviation from the expected feedback can be defined with respect to a certain threshold, which sets the tolerance of the system.

The source pulse must have a sufficient energy to travel through the tensile element. Hence, the parameters of the source pulse shall be determined accordingly, taking into account inter alia the length and resistivity of the tensile elements.

Preferably the source pulse has a time duration of around 100 nanoseconds and even more preferably less than 100 nanoseconds. A small duration is preferred to avoid or at least reduce the occurrence of the feedback pulse overlapping the source pulse, which may happen if the damage is too close to the point when the source pulse is injected. Preferably the amplitude of the pulse is less than 50 V, provided it is sufficient to deliver the energy required. A low voltage is preferred to avoid the need of insulation.

A device for carrying out the above method can be integrated in an elevator system. An aspect of the invention is an elevator system according to the attached claims. Said elevator system comprises at least: a car, a load-bearing member including tensile elements made of electrically conductive material and encapsulated in a case, and a checking device for checking the integrity of said load-bearing member according to the method of the invention.

The checking device comprises means to launch a pulse in the tensile elements, such as one or more pulse generators, and a comparator arranged to compare their feedback.

Said checking device may be configured to carry out the test automatically or on manual command. In some embodiments, the checking device performs the test at given intervals of time and/or when certain conditions are met, for example when the elevator car is resting at the lowest floor and hence the load-bearing member is fully deployed, which is the preferred condition for testing the load-bearing member.

In a manual embodiment, the elevator system preferably comprises a suitable interface accessible to the qualified personnel only. For example a control panel of the elevator may include a test button to perform the inventive method and receive a signal such as "green light" or "alarm". Accordingly, the integrity of the load-bearing member can be checked manually when it is appropriate, e.g. during the routine maintenance of the elevator system.

In other embodiments, the test can be performed with suitable external equipment including the means to generate the pulse and receive and compare the feedback. Said means shall be electrically connected to suitable interface means of the tensile elements of the load-bearing member.

In the preferred application of the invention, the elevator is a counterweight-less elevator and the load-bearing member has the form of a belt. The term belt is used to denote a load-bearing member which typically has a width substantially larger (e.g. several times larger) than thickness. According to various embodiments, said belt can be a toothed belt or a flat belt. The tensile elements can be metal cords, such as steel cords, made of several strands. The load-bearing member may also include non-metal tensile elements. For example the invention can be applied to a load-bearing member as disclosed in WO-A-2009 090299.

The case where tensile elements are encapsulated is of a higher resistivity than the tensile elements. For example the tensile elements are steel cords or stainless steel cords and the case is made of a plastic material such as polyurethane (PU).

The invention also relates to an elevator system according to the attached claims.

The advantages of the invention will be now elucidated with reference to the attached figures.

DETAILED DESCRIPTION OF PREFERRED EMBODIMENTS

Figure 1:
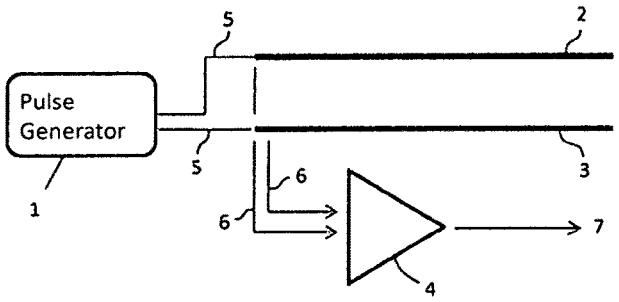
FIG. 1 is a scheme of a first way of carrying out the inventive method, according to a first embodiment.

Referring to FIG. 1, the block 1 denotes a pulse generation unit, which may include one or more pulse generators, connected to tensile elements of a load-bearing member of an elevator. Said tensile elements are for example steel cords 2, 3. A comparator 4 is also electrically connected to said steel cords 2, 3.

The unit 1 can launch a pulse through the steel cords 2, 3 while their feedback can be compared by means of the comparator 4.

The method comprises preferably the following steps. A pulse generated by the unit 1 and having a known amplitude and duration, for example 50 V and 100 ns, is launched through steel cords 2, 3 via the input connections 5.

In each cord 2 or 3, the pulse will normally travel the whole length of the cord. Depending on the cords being grounded or not, the cords 2, 3 are expected to give a certain feedback pulse or no feedback. However, a damage of the cord will result in a different feedback pulse, as elucidated for example in FIG. 3.

Any feedback reaches the comparator 4 via connections 6. The output 7 of the comparator 4 is normally expected to be null or close to null; a non-null output 7, possibly over a certain threshold, may be interpreted as a damage of one of the cords 2, 3.

Figure 2:
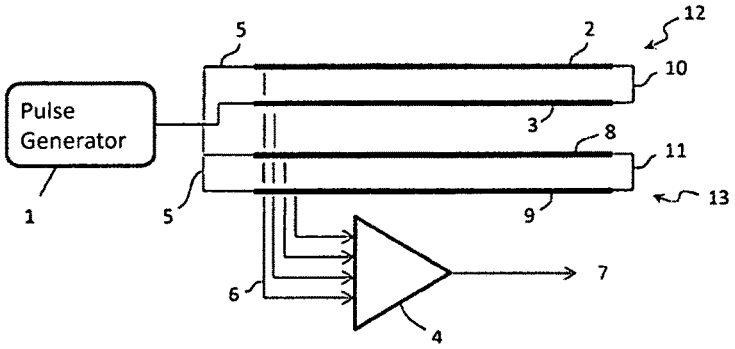
FIG. 2 is a scheme of another way of carrying out the inventive method, according to a second embodiment with bridged tensile elements.

FIG. 2 relates to a bridged embodiment of the invention.

The steel cords 2, 3 and 8, 9 are bridged by means of bridge connections 10, 11 to form two pairs 12, 13.

The method involves basically two steps. A source pulse is launched into one steel cord of each pair 12 and 13, for example cords 2 and 8, and the feedback pulse (received via connections 6) is checked by the comparator 4. Then, a source pulse is launched into the other steel cord of each pair, in the example the cords 3 and 9, and again the feedback pulses are analysed. This method avoids the blind zone since for example a damage undetected in the first step, being too close to the connection to pulse generator 1, will be revealed in the second step, or vice-versa.

Figure 3:
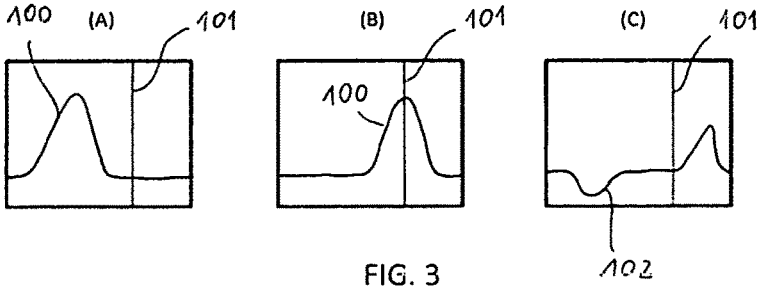
FIG. 3 shows an example of pulse and feedback which denote a damage in a tensile element, according to the invention.

FIG. 3 shows the principle underlying the invention. A source pulse 100 having a known amplitude and duration is launched through a conductive tensile element, for example a steel cord (FIG. 3, A). Line 101 denotes the position of a damage of the cord, for example a location where the cord is worn and/or the cross section is reduced due to failure of some of the wires which compose the cord. The damage 101 will normally reflect at least partly the source pulse 100 (FIG. 3, B), thus generating an unexpected feedback 102 (FIG. 3, C) which can be interpreted as a symptom of a damage. Furthermore, knowing the speed of the source pulse and the length of the tensile cords, the system may calculate and show the location of the damage 101 along the cord.

Figure 4:
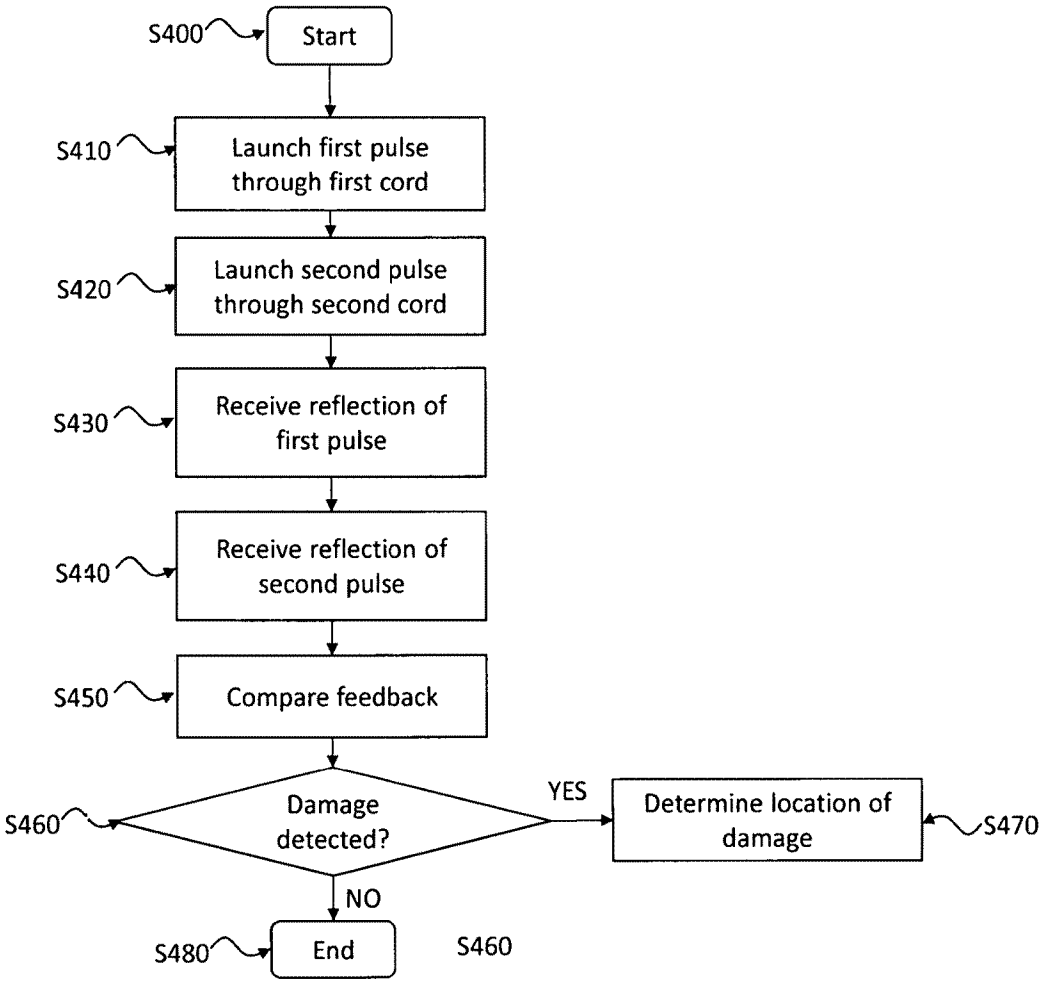
FIG. 4 shows an example of a method of launching and receiving pulses, according to example embodiments.

FIG. 4 shows an example of a method of launching and receiving pulses, according to example embodiments. In FIG. 4, the method may start at step S400. Beginning in step S410, a first pulse signal may be launched from the pulse generating unit 1 through the first cord 2. The first pulse signal may be, e.g., less than or equal to 50 V and last for less than or equal to 100 ns. Beginning in step S420, a second pulse signal may be launched from the pulse generating unit 2 through the second cord 3. The second pulse signal may be, e.g., less than or equal to 50 V and last for less than or equal to 100 ns. In step S430, a reflected signal of the first pulse signal may be received, as the first pulse signal travels down cord 2 and is reflected back. In step S440, a reflected signal of the second pulse may be received, as the second pulse signal travels down cord 3 and is reflected back. In step S450, the reflected first pulse signal and the reflected second pulse signal may be compared with the comparator 4. Based on a comparison of the first reflected pulse signal and the second reflected pulse signal, damage may be detected in any unexpected feedback signal, such as the unexpected feedback signal 102. If damage is detected, a determination of the cord affected and the damage location may be determined, for example by knowing a speed of the source pulse and a length of the cord in step S470. In step 480, the method may end.

The invention is applicable to various load-bearing members of elevators. For example the load-bearing member may be a belt with steel cords in a polyurethane body, and each cord is composed of several steel tangled wires. The invention however may be applied to other embodiments including load-bearing members with non-metallic tensile elements.

The invention claimed is:

1. A method of testing at least one load bearing member of an elevator system, the at least one load bearing member including tensile elements of electrically conductive material encapsulated in a case, the method comprising:

transmitting a first source pulse through a first one of the tensile elements and a second source pulse through a second one of the tensile elements, and determining a condition of the tensile elements based on a first feedback signal received via the first one of the tensile elements and a second feedback signal received via the second one of the tensile elements.

2. The method according to claim 1, wherein the determining a condition comprises:

determining that the condition of one of the first one of the tensile elements and second one of the tensile elements is a damaged tensile element, if a difference between the first feedback signal and the second feedback signal is greater than a threshold.

3. The method according to claim 2, further comprising:

determining which of the tensile elements is the damaged tensile element, if the difference is greater than the threshold, the determining which of the tensile elements is the damaged tensile element including, transmitting a third source pulse through a third one of the tensile elements, and determining which of the tensile elements is the damaged tensile element based on the first feedback signal, the second feedback signal and a third feedback signal, the third feedback signal being received via the third one of the tensile elements.

4. The method according to claim 1, further comprising:
selecting the first one of the tensile elements and the second one of the tensile elements such that each of the tensile elements of a first load bearing member of the at least one bearing member are compared to the tensile elements of the first load bearing member and the tensile elements of a second load bearing member of the at least one bearing member according to a pattern.

5. The method according to claim 1, wherein the determining the condition of the tensile elements comprises:
comparing one or more of transmission time differences, amplitude differences, and waveform differences between the first source pulse and the first feedback signal and between the second source pulse and the second feedback signal.

6. The method according to claim 1, wherein the first one of the tensile elements includes a first pair of bridged tensile elements connected via a first bridge connection, and the second one of the tensile elements includes a second pair of bridged tensile elements connected via a second bridge connection, and the method further comprises:
transmitting a pulse from a first one of the first pair of bridged tensile elements to the first bridge connection;
transmitting a pulse from a first one of the second pair of bridged tensile elements to the second bridge connection;
transmitting a pulse from a second one of the first pair of bridged tensile element to the first bridge connection; and
transmitting a pulse from a second one of the second pair of bridged tensile elements to the second bridge connection.

7. The method according to claim 1, wherein the first source pulse and the second source pulse are identical.

8. The method according to claim 1, wherein the transmitting transmits the first source pulse and the second source pulse simultaneously.

9. The method according to claim 1, wherein the transmitting transmits the first source pulse and the second source pulse such that a time duration of each of the first source pulse and the second source pulse is less than or equal to 100 nanoseconds.

10. The method according to claim 1, wherein the first source pulse and the second source pulse have an amplitude less than or equal to 50 V.

11. An elevator system comprising:
at least one elevator car;
at least one load-bearing member, the load bearing member including at least one tensile element made of electrically conductive material and encapsulated in a case; and
a testing device configured to test an integrity of the load-bearing member, the testing device including,
a pulse generator connected to at least the tensile elements of the load-bearing member, the pulse generator configured to transmit a first source pulse through a first one of the tensile elements and a second source pulse through a second one of the tensile elements, and
a comparator configured to determine a condition of the tensile elements based on a first feedback signal received via the first one of the tensile elements and a second feedback signal received via the second one of the tensile elements.

12. The elevator system according to claim 11, wherein the testing device is configured to periodically test the integrity of the tensile elements.

13. An elevator system according claim 11, wherein the testing device is configured to test the integrity of the tensile elements, if a call of the elevator car is made when the elevator car is positioned at a lowest floor.

14. An elevator system according to claim 11, wherein the load-bearing member is a belt and the elevator car has no counterweight.

15. An elevator system comprising:
at least one car;
at least one load-bearing member connected to the at least one car, the load bearing member including tensile elements made of electrically conductive material and encapsulated in a case made of electrically resistive material; and
a testing device configured to test an integrity of the at least one load-bearing member, the testing device including a pulse generator connected to the tensile elements of the at least one load-bearing member, the pulse generator configured to,
transmit a first source pulse through a first one of the tensile elements and a second source pulse through a second one of the tensile elements, and
determine a condition of the tensile elements based on a first feedback signal received via the first one of the tensile elements and a second feedback signal received via the second one of the tensile elements.

16. The method of claim 1, wherein the testing includes,
testing the integrity of the tensile elements in response to a call on the elevator system occurring when a car of the elevator system is on a lowest floor.

17. The method of claim 1, wherein the at least one load bearing member is a belt and a car on the elevator system does not include a counterweight.

18. The elevator system of claim 15, wherein the testing device is configured to test the integrity of the at least one load bearing member, if a call of the at least one car is made when the car is positioned at a lowest floor.

19. The elevator system of claim 15, wherein the at least one load-bearing member is a belt and the at least one car has no counterweight.

* * * * *